United States Patent [19]

Sweeney et al.

[11] 3,976,807

[45] Aug. 24, 1976

[54] MOCK OWL DISPLAY

[76] Inventors: Doris Sweeney, 512 A Taylor Ave., Warrington, Pa. 18476; Mary Ellen Lee, 7951 Anita Drive, Philadelphia, Pa. 19111

[22] Filed: Feb. 7, 1975

[21] Appl. No.: 548,024

[52] U.S. Cl. ..... 428/16; 35/26; 46/124; 46/156; 156/61; 156/63; 206/223; 428/6; 428/39

[51] Int. Cl.[2] ..... A41G 11/00; B44C 5/04

[58] Field of Search ..... 35/26; 156/63, 61; 206/45.33, 223; 428/13–16, 6, 39, 542, 7, 323; 46/124, 156, 158, 160

[56] References Cited

UNITED STATES PATENTS

| | | | |
|---|---|---|---|
| 1,876,121 | 9/1932 | Wilson | 46/158 |
| 2,582,514 | 1/1952 | Swisher et al. | 46/124 X |
| 2,876,575 | 3/1959 | Leika | 156/248 |
| 2,937,931 | 5/1960 | Nugent | 428/15 |
| 3,041,778 | 7/1962 | Seron | 46/22 |
| 3,176,836 | 4/1965 | Gunn | 206/45.33 |
| 3,402,093 | 9/1968 | Riva | 206/223 X |
| 3,734,509 | 5/1973 | Glass et al. | 273/DIG. 24 |

*Primary Examiner*—Harold Ansher
*Assistant Examiner*—Henry F. Epstein

[57] ABSTRACT

A mock-owl display and a seed kit for preparing same which comprises: sunflower seeds and rice adfixed to a flat support which is in the shape of an owl. To enhance the desired effect there is also used: two simulated eyes, a twig for a perch and cutouts to represent an owl's beak and talons.

The sunflower seeds represent the owl's feathers and by adfixing them to the support in various positions there is obtained a three dimensional effect and a feathered appearance which is unique and visually appealing.

8 Claims, 6 Drawing Figures

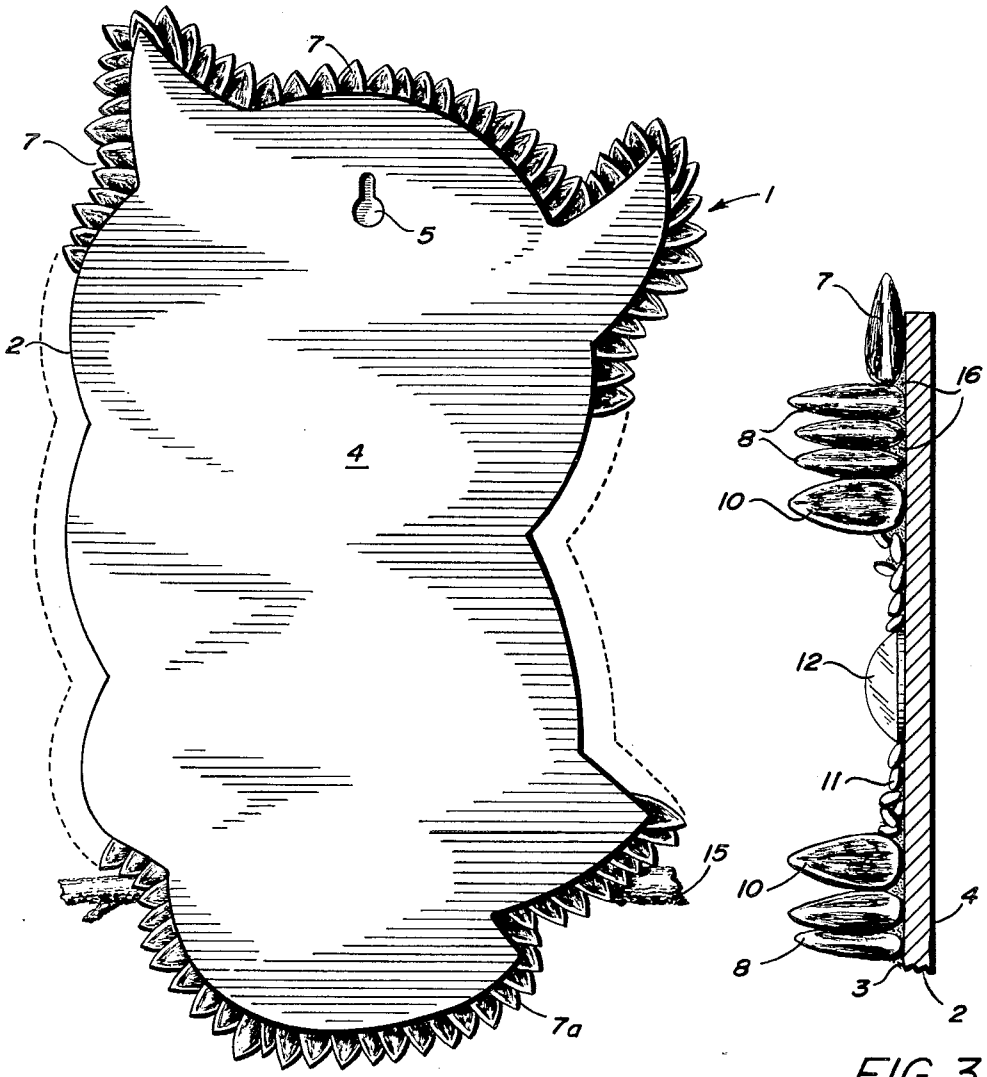
FIG. 3
FIG. 2
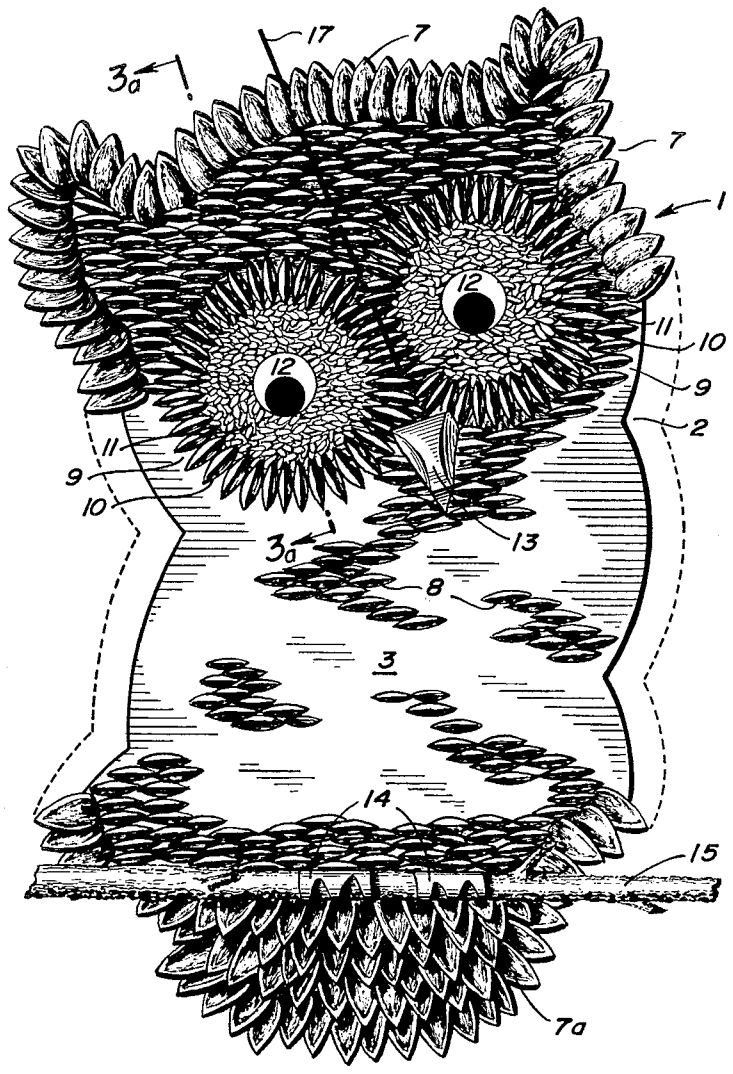
FIG. 1

MOCK OWL DISPLAY

This invention relates to a mock-owl display and to a seed kit for preparing same. It utilizes the unique characteristics of sunflower seeds to create an owl-shaped seed picture which is characterized by a three-dimensional effect and a feather-simulated appearance.

BACKGROUND

It is known in the art to use the seeds of plants to construct seed pictures.

In U.S. Pat. No. 2,937,931, there is described the use of navy beans to trace various patterns on cardboard, as, for example, the outline of a sailboat on water. The beans are colored with a vegetable dye and lacquered for protective purposes.

In U.S. Pat. No. 3,176,836, another seed kit is described. This kit provides several different types of vegetable seeds of various (natural) colors for the purpose of adhesively bonding them to a pattern to create a seed picture. The seeds are housed in individual containers which have been marked in such wise as to correspond to markings which appear in the demarcated areas of an accompanying pattern. By matching the seeds with the area to be covered a multi-colored seed picture is obtained.

However, neither of the above patents or the prior art in general, recognizes the unique attributes of sunflower seeds in creating seed pictures.

THE INVENTION

We have found, surprisingly, that a mockowl display can be constructed by taking advantage of the size, shape and color of sunflower seeds so as to create a seed picture having a three-dimensional effect and a unique feathered appearance.

Unlike U.S. Pat. No. 2,937,931, which provides for tracing the outline of a picture with artificially colored seeds, this invention uses sunflower seeds to virtually cover an entire pattern. Furthermore, there is no need to color the sunflower seeds because their natural color actually contributes to the novel effect of this display.

This invention is also distinguishable from known seed pictures in still another respect. Thus, whereas U.S. Pat. No. 3,176,836 provides for the filling in of demarcated areas on a pattern with variously colored seeds of different types, this invention utilizes, essentially, seeds of only one type and having only one basic color. Thus, this invention does not rely upon the multicolored effect imparted by different colored seeds; nor does it depend upon the mental exercise of matching designated seeds with corresponding designated areas on an imprinted pattern.

Indeed, the pattern used in the present invention serves as still another distinguishing feature when compared against known seed kits. Thus, whereas the seed kits of U.S. Pat. No. 2,937,931 and U.S. Pat. No. 3,176,836 use patterns which are imprinted onto a rectangular or square surface, the present invention employs a base or support which is preshaped to the figure of an owl.

Sunflower seeds have not heretofore been used in creating seed pictures but we have found them to be ideally suited for positioning purposes. Because of their generally flat and elongated shape, they can be positioned at various angles and can overlap one another to afford a variety of pleasing effects. Also, because of their size, they lend themselves to being placed in rows or various other positions as, for example, in either a flat or upright position or overlapping, to give the appearance of depth and a feathered effect which is most attractive to behold.

Unlike known seeds kits, as stated above, this invention does not use artificially colored seeds to achieve its novel effect; nor does it combine seeds of various colors within designated areas to obtain precise patterns. Instead, the essence of this invention resides in the fact that sunflower seeds can be positioned at various angles and in a variety of patterns to afford a mosaic effect and a melange of unusually attractive designs. They are the ideal seed for improvisation, manipulation and arrangement. The result is a variety of effects reflecting the imagination of the creator.

And although this invention will hereinafter be particularly described with reference to the drawings and a single embodiment, it is to be understood that the drawings are for illustrative purposes only and that this invention embraces the various permutations of displays which can be designed using the instant seed kit.

UTILITY

This invention has utility in a wide variety of fields. It is recreational in the sense that it is interesting and diversionary; it provides entertainment and is a pleasurable past-time for both children and adults.

It is also therapeutic. It provides enjoyment for convalescents, the aged and the debilitated and, in addition, it may be used to assist those who suffer from chronic absorptive arthritis and arthritis mutilans and who need encouragement in the use of their fingers and hands. Thus utilized, it offers the reward of successful accomplishment and serves to measure the degree of recovery of the patient.

This invention is also educational. It encourages children to organize and develops their ability to create. Moreover, it provides its own rewards of accomplishment and constructive activity.

CONSTRUCTION

In general, this invention covers a mock-owl seed kit, the manner of using same, and the display or seed picture obtained thereby.

a. The Display: Essentially, this display consists of:

1. a flat support which circumscribes the figure of an owl and to which is adfixed,
2. sunflower seeds and rice in a patterned arrangement to simulate feathers; including
3. a twig for a perch;
4. two simulated eyes, and
5. cut-outs to represent an owl's beak and talons.

The advantage of this invention when compared against known seed kits lies in the unique attribute of sunflower seeds to be positioned into various arrangements and also, in their unique coloring which resembles, to an unusual degree, the color of the common owl. Thus, the use of sunflower seeds provides the designer with the ability to improvise and to create constantly new designs.

However, for exemplary purposes, this invention will be illustrated by reference to a preferred embodiment. In this embodiment, the display consists of a pattern on the front side of the support (hereinafter "support") to guide the designer in positioning the seeds, the perch, the eyes and the cut-outs.

According to this embodiment, the pattern on the support indicates the location of both eyes, the position of the perch including the owl's talons, and the position of the owl's beak.

Also in this embodiment, the pattern on the support includes a concentric ring around each eye, the perimeter of which is circumscribed by a a circular row of sunflower seeds set in an upright or standing position.

Further, this embodiment provides that the circular row of seeds around one eye should come into intimate contact with the circular row of seeds of the other eye, as a result of which they interlace at a point immediately above the owl's beak.

The pattern further provides that within each circular seed row, there is circumscribed a field of rice in the center of which is a simulated eye.

Also, according to this embodiment, the pattern on the support provides for a single row of seeds to be set along the periphery of the owl-shaped support; these seeds are to be positioned flat, should overlap slightly and have their points facing outward.

This embodiment also provides for a pattern which indicates that tail feathers are to be simulated by positioning those seeds flat against the support with their tips pointing outward and with a portion of said tips overlapping any immediately preceding seeds.

Finally, according to this embodiment, the remaining seeds on the support are positioned in parallel with their tips pointing up, either in contact with one another or in reasonably close contact with one another.

b. The Seed Kit: In general, the seed kit of this invention consists essentially of the following:

1. sunflower seeds and rice and containers therefor;
2. two simulated eyes;
3. a twig to serve as a perch;
4. cut-outs to represent a beak and talons;
5. glue or paste; and
6. a flat support having a front side and back side which contains on its front side a pattern indicating:
   a. the position of the simulated owl-eyes;
   b. the position of the twig which serves as the perch;
   c. the position of the cut-outs which represent the beak and talons;
   d. the location of the areas to which the rice is to be adfixed; and
   e. the areas where the sunflower seeds must be adfixed and positioned so as to afford the desired three-dimensional effect and feathered appearance.

The positions of the sunflower seeds may be varied to suit the preference of the designer but, in a preferred embodiment of this invention, the sunflower seeds, perch, cut-outs and eyes are placed according to the pattern indicated on the face of the support as follows:

The seeds adfixed to the perimeter of the support are positioned flat and overlap slightly with the seed points extending outward.

The pattern provides a position for the two simulated eyes.

A single row of seeds circumscribe each eye and the seeds in both rows are positioned upright; the seed rows circumscribing each eye come into contact with one another and interlace at a point immediately above the position designated for the beak.

The seeds circumscribing each eye encircle a field of rice in the center of which is a simulated owl-eye.

The effect of tail feathers is created by positioning and adfixing the sunflower seeds in the designated area, flat against the support, with the tips of the seeds pointing outward and with the said tips overlapping slightly with the seed or seeds immediately preceding it.

The remaining sunflower seeds are positioned identically, in parallel, in an upright position either in contact with one another or in close proximity to one another.

The foregoing will be better understood by a consideration of the following description which sets forth the steps used in reducing the invention to practice.

c. Method:

The seed kit is employed in the following manner:

1. the owl-shaped base is placed on a flat surface with the pattern side facing up;
2. the two concentric rings or circles circumscribing each eye is covered with glue and a single tight row of sunflower seeds is impressed in an upright position into the glue. In practice, we find it desirable to begin the impression of the seeds at a point immediately between the two concentric circles, i.e., at the point immediately above the owl's beak where the two circles come closest to touching; at this juncture the seed rows interlace (i.e., follow consecutively) and ultimately diverge as the two circles diverge.
3. After the seeds have been impressed around the perimeters of both concentric circles, the pattern is allowed to dry.
4. The outer perimeter of the owl-shaped base is treated next. Glue is placed on the outer edges of the owl-shaped base, in sections, beginning, preferably, with the tips of each ear and the sunflower seeds are pressed flat into the glue with slight overlapping and with the points of the seeds facing outward.
5. The area within the concentric circles (i.e., within the seed rows circumscribing each eye) is covered with glue and the two simulated eyes are impressed into the center of the said circles.
6. Rice is poured over the remainder of the glued area; the rice is pressed into the glue and excess rice is poured off.
7. The remainder of the owl, above the perch, is given a coat of glue, in sections, and sunflower seeds are impressed upright, in parallel, into each of the glued sections as close together as possible. In practice, we find it desirable to work from the top of the display down to the perch.
8. The tail section of the display is designed next. Glue is spread in the area below the perch and the sunflower seeds are pressed flat into the glue at radiating angles with the points of the seeds slanted toward the bottom of the support. We find it desirable to work from the bottom of the base up to the perch or twig line.
9. The talon cut-outs are glued onto the twig which serves as the perch and the twig is then glued onto the base in the manner indicated on the pattern (i.e., immediately above the last row of seeds in the tail section).
10. Glue is placed on the upper edge of the beak cut-out and this item is impressed between the seeds at a point immediately below the point where the two concentric circles (i.e., the seed rows encircling the owl's eyes) converge.

11. If desired, the resulting seed picture can then be sprayed with a clear lacquer for protective purposes and to impart a sheen to the display.

The glue which is used in this display is any thick glue which sets quickly and dries clear. Due to the bulk of the sunflower seeds, it is desirable to apply the glue liberally, preferably, at a thickness of about ½ inch.

The cut-outs which serve as the beak and talons in this display may be of any tractable sheet material which is capable of being cut with scissors or a similar instrument and which may then be suitably shaped. Alternatively, in any commercial operation, the said beak and talons would be stamped out with a press using dies which would cut the sheet material in the shapes shown in FIG. 1, items 13 and 14. Typical of the material which may be used is aluminum, preferably, of the anodized variety and tinted gold or bronze for esthetic purposes. However, it is to be understood that the precise nature and color of the sheet material and cutouts in this invention is not critical and, in practice, any functionally equivalent material, such as a heavy paper or cardboard, may be used.

The sunflower seeds and rice are maintained within the kit in separate containers. The containers may be any suitable receptacle such as a bag, envelope or blister package but, in practice, we prefer to use a transparent bag made of cellophane, plastic or the like. Also, the container may be equipped with a means for resealing it as a convenience to the designer. An adhesive strip is most suitable for this purpose. Also, in the interest of economy, the containers may be designed to hold only a slight excess of the seeds needed to complete the display.

THE SEEDS:

The sunflower seeds used in this display are of the common variety. Sunflowers are of two types: perennials and annuals.

Perennials:

The seeds of the perennial are neither sufficiently large or colorful to be of any practical use in this invention.

Annuals:

The annual variety of sunflower is divided into two categories: Helianthus and Tithonia. Both are prolific seed producers (a single flower bears more than two thousand seeds) but only the Helianthus produces seeds of sufficient size and color to be used to any advantage in this display.

The Helianthus sunflower is itself divided into two species, namely, *H.annuus* (common sunflower) and *H.debilis* (cucumber leaf sunflower). The seeds of both species are suitable for use in this invention and when "seeds" are referred to in this specification, it is to be understood that the *H.annuus* and *H.debilis* varieties are intended. However, a preferred embodiment of this invention consists in utilizing only the seeds of the *H.annuus*variety, i.e., the common sunflower, in this display.

The common sunflower (H.annuus) grows as tall as 10 feet or more with single yellow blossoms 8 to 14 inches across; its only major function is to produce seeds. It does this prolifically and produces seeds of such large dimensions that they are particularly suitable for use in this display.

The cucumber leaf sunflower (*H.debilis*) produces bright flowers with blossoms about 3 inches in circumference, through many shades of white, yellow and orange to chestnut and even rosy lavender and maroon, but they do not produce seeds in as great numbers or of as large a dimension as the common sunflower (*H.annuus*).

DRAWINGS:

This invention will now be described by reference to the drawings. However, it is to be understood that the drawings are for illustrative purposes only and are not intended to be limitative. Thus, for example, the shape of the base or support in this display can be modified to suit the preference of the designer; and, likewise, the shape and size of the beak and talon cutouts can be altered without departing from the spirit of this invention.

FIGS. 1 to 6 illustrate one embodiment of this invention.

FIG. 1 is a front view of the owl-display partially completed.

FIG. 2 is a back side-view of FIG. 1.

FIG. 3 is a cut-away edge view as seen from the top of FIG. 1 along 3a.

FIG. 4 is a front view of the owl-display completely assembled.

FIG. 5 is a back-side view of FIG. 4.

FIG. 6 is a side view of the owl-display completely assembled.

Figure 6:
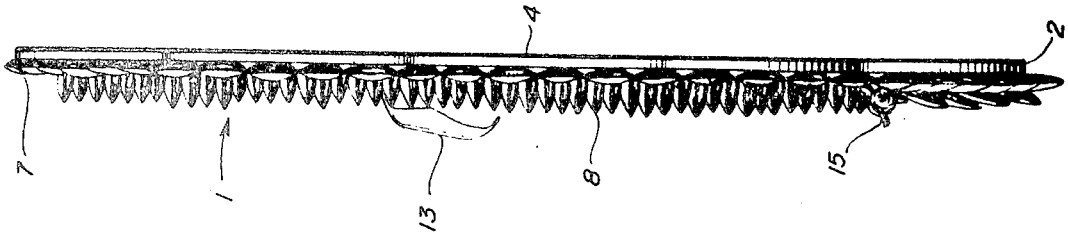
Figure 5:
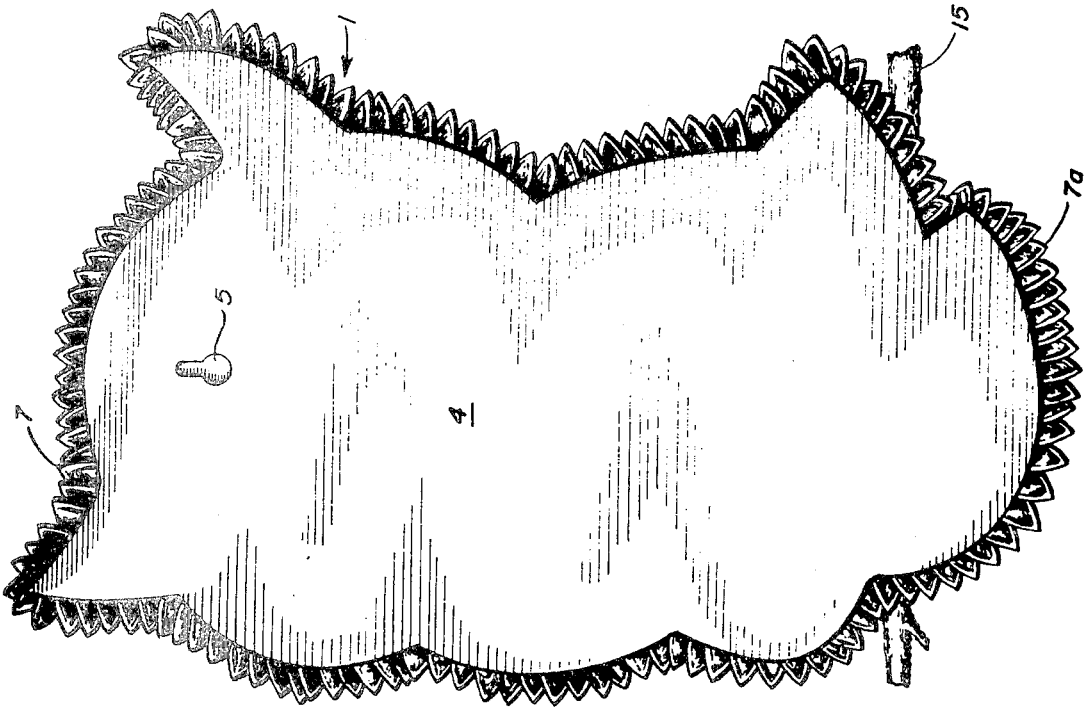

The various parts of the display and seed kit, will now be described by reference to the numerals in FIGS. 1 to 6.

The display 1 consists of a flat support or base 2 in the shape of an owl having a front side 3 and a back side 4. The support 2 may be any suitable sheet material as, for example, fiberboard, cardboard or plastic, but, in practice, we prefer to use fiberboard or cardboard of a rigid or semi-rigid type.

Although a pattern may be imprinted on the front side 3 of support 2, it is not essential that this be done, because one feature of this invention lies in the facility of the seeds to be positioned at various angles thus permitting the designer to improvise and create different types of owl displays.

The sunflower seeds have a shape and bulk which makes them ideally suited for creating this display. Their size is small enough to be used in creating delicate patterns and intricate designs, yet large enough to be handled easily. In addition, they possess a color, shape and texture which enhances the effect they are intended to produce.

To assemble the owl display 1 the support 2 is placed on a table or the like, with the front side 3 facing up.

The sunflower seeds 7, 8 and 9 are then adfixed to the support 2 by applying an adhesive 16; FIG. 3 such as glue to the front side 3 thereof FIG. 1.

Figure 4:
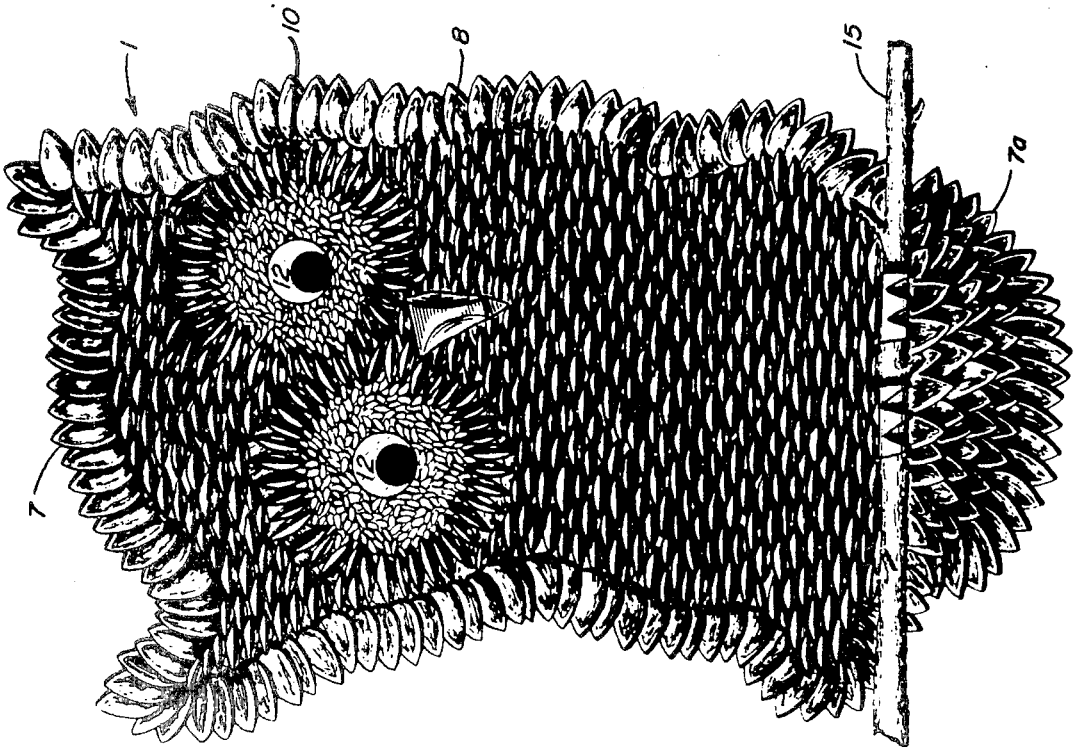

Preferably, the section of the display to be first covered with seeds are the two circumscribed circles designated as seed rows 10 in FIGS. 1 and 4. These two seed rows 10 are in an upright position.

FIG. 3 shows one of these seed rows 10 partially completed. The seeds within each row are placed as close together as possible.

In practice, it is preferable to begin the circular seed rows 10 at the point where they interlace, namely, at 17 in FIG. 1. The perimeter of the circles on the support 2 are covered with glue 16, FIG. 3 which is applied in about ½ inch thickness. The seeds are then impressed into the glue in an upright position beginning at point 17 FIG. 1 and proceeding around each circle until both seed rows 1 are completed. The seed rows are then allowed to dry.

The outer edges of the support 2 are treated next. Glue 16 is applied in about ½ inch thickness to one of the two ears and the seeds are impressed therein in a flat position, beginning with the tip of said ear. The seeds 7 are positioned in such a manner as to overlap slightly with each preceding seed with the tip of each seed pointing outward. This procedure is repeated with the second ear.

The next step consists of covering the remaining edges of the support 2 with seeds. This is accomplished by applying glue, again, in about ½ inch thickness, in sections, to the outer edges of the support 2 and impressing therein the seeds 7 in an arrangement identical to that described in the preceding paragraph until the entire perimeter of the support, up to the twig line, is lined with seeds. The twig line is represented by perch 15 in FIGS. 1, 2, 4 and 6.

When the glue has dried sufficiently, the eyes of the owl display are completed by applying glue to the area within the perimeter of the circular seed rows and impressing the two simulated eyes 12 into the center of the said circles.

Rice 11 FIG. 3 is then poured over the remainder of the glued area and the rice is impressed into the glue and excess rice is poured off.

The next step consists of applying glue to sections of the support above the twig line 15 and impressing sunflower seeds therein in an upright position, in parallel, as close together as possible 8; FIG. 3. Generally, it is desirable to work from the top of the display down toward the perch but this is a matter of preference and may be modified to suit the wishes of the designer.

The tail section *7a* of the display is designed next. Beginning at the bottom of support 2 and working up to the perch or twig line 15, glue is spread in the area below the perch and seeds are pressed flat into the glue at radiating angles with the points of the seeds slanted toward the bottom of the support 2.

Next, the talon cut-outs 14 are glued onto the twig 15, and the latter is then glued onto the support 2 in the space which separates the upright seeds from the radiating tail seeds, that is, immediately above the last row of seeds in the tail section of the display.

Finally, the beak 13 is glued onto the support 2 by applying glue to the back thereof, and impressing the said beak 13 down between the seeds, as shown in FIG. 6.

The display is then allowed to dry and, if desired, it may be sprayed with a clear lacquer for protective purposes and to impart a sheen to the arrangement.

The display may then be hung upon the wall by aperture 5 or used in any other obvious manner as a decoration.

What is claimed is:

1. A mock-owl display consisting essentially of:

1. a flat support which circumscribes the figure of an owl and to which is adfixed,
2. sunflower seeds and rice in a patterned arrangement to simulate feathers; and including
3. a twig for a perch,
4. two simulated eyes, and
5. cutouts to represent an owl's beak and talons.

2. The display of claim 1 wherein each eye is circumscribed by a circular row of sunflower seeds set in an upright position.

3. The display of claim 2 which is further characterized by the seeds of one row coming into intimate contact with the seeds of the second row whereupon they interlace at a point immediately above the owl's beak.

4. The display of claim 3 wherein both of the circular seed rows circumscribe a field of rice in the center of which is a simulated eye.

5. The display according to claim 1 wherein the mock-owl effect is enhanced by positioning the sunflower seeds at various angles.

6. The display of claim 5 wherein a single row of seeds along the periphery of the owl-shaped support are positioned flat, overlap slightly and have their points facing outward.

7. The display of claim 5 wherein tail feathers are simulated by positioning the seeds flat against the support with their tips pointing outward and with a portion of the said tips overlapping any immediately preceding seeds.

8. The display of claim 5 wherein the remaining seeds are positioned in parallel with their tips pointing up, either in contact with one another or in reasonably close contact with one another.

* * * * *